US010801206B2

(12) United States Patent
Folkersen et al.

(10) Patent No.: US 10,801,206 B2
(45) Date of Patent: Oct. 13, 2020

(54) MULTI-PART UNDERLAYMENT FOR BUILDING ENVELOPE DETAILS

(71) Applicant: Roofers' Advantage Products LLC, E. Wakefield, NH (US)

(72) Inventors: Jonny E. Folkersen, East Wakefield, NH (US); Benjamin J. Folkersen, East Wakefield, NH (US)

(73) Assignee: Roofers' Advantage Products, LLC, E. Wakefield, NH (US)

( * ) Notice: Subject to any disclaimer, the term of this patent is extended or adjusted under 35 U.S.C. 154(b) by 0 days.

(21) Appl. No.: 16/375,456

(22) Filed: Apr. 4, 2019

(65) Prior Publication Data

US 2019/0309519 A1 Oct. 10, 2019

Related U.S. Application Data

(60) Provisional application No. 62/652,504, filed on Apr. 4, 2018.

(51) Int. Cl.

| | |
|---|---|
| ***E04D 1/36*** | (2006.01) |
| ***E04D 1/28*** | (2006.01) |
| ***E04B 1/68*** | (2006.01) |
| ***E04D 1/34*** | (2006.01) |
| ***E04B 1/64*** | (2006.01) |

(52) U.S. Cl.

CPC ..... *E04D 1/36* (2013.01); *E04B 1/642* (2013.01); *E04B 1/68* (2013.01); *E04D 1/28* (2013.01); *E04D 1/34* (2013.01); *E04D 2001/3423* (2013.01); *E04D 2001/3435* (2013.01); *E04D 2001/3444* (2013.01)

(58) Field of Classification Search

CPC .... E04D 1/36; E04D 1/28; E04D 1/34; E04D 2001/3444; E04D 2001/3423; E04D 2001/3435; E04B 1/68; E04B 1/642

See application file for complete search history.

(56) References Cited

U.S. PATENT DOCUMENTS

| | | | | |
|---|---|---|---|---|
| 4,992,315 | A | 2/1991 | Zickell et al. | |
| 2004/0055240 | A1* | 3/2004 | Kiik | B32B 5/26 52/545 |
| 2008/0155923 | A1* | 7/2008 | Teng | E04D 1/26 52/409 |
| 2009/0158685 | A1* | 6/2009 | Swanson | E04D 1/34 52/543 |
| 2016/0244969 | A1* | 8/2016 | Beerer | E04D 1/28 |

* cited by examiner

*Primary Examiner* — Patrick J Maestri

(74) *Attorney, Agent, or Firm* — Maine Cernota & Rardin

(57) ABSTRACT

A multi-part roofing underlayment having independent release liners, where the underlayment comprises separable portions attached adjacent top edges of the separable portions, creating an interface therebetween into which roofing components may be inserted, easing installation and better mitigating wind-driven rain and ice dam related roof failures. Embodiments provide the multi-part roofing underlayment in sheet and roll forms and with various configurations of release liners, adhesive layers, granular layers, selvedge edges, and plastic layers.

20 Claims, 7 Drawing Sheets

MULTI-PART UNDERLAYMENT FOR BUILDING ENVELOPE DETAILS

RELATED APPLICATIONS

This application claims the benefit of U.S. Provisional Application No. 62/652,504, filed Apr. 4, 2018. This application is herein incorporated by reference, in its entirety, for all purposes.

FIELD OF THE INVENTION

The invention relates to roofing, and, more particularly, to underlayment having use in roofing applications.

BACKGROUND OF THE INVENTION

Wind-driven rain and ice dam related roof failures are currently mitigated using a variety of self-adhesive products, commonly known as underlayment, in combination with metal flashing. The self-adhesive products are typically offered in roll form and, once unrolled, create a sheet onto which roofing products can be installed.

Metal flashing components used in conjunction with underlayment are typically are made of aluminum. While aluminum nails do exist, the nails most often used to secure flashing to a building envelope are made of galvanized steel. Under atmospheric conditions of moderate to mild humidity, contact between a galvanized surface and aluminum is unlikely to cause substantial incremental corrosion. Under very humid conditions, however, the interface between the galvanized nail and the aluminum flashing will experience greatly accelerated corrosion, unless electrically isolated from the aluminum.

Furthermore, water leaks into a building envelope are a primary consideration when constructing a roof. To this end, existing metal flashing is typically placed directly on top of an underlayment. However, any moisture that is able to penetrate the shingles or other outer roof layer may also penetrate the interface between the metal flashing and underlayment, allowing moisture to flow into areas in which it may cause issues. To prevent this, many roofers will utilize a roof cement at this interface, however, this application of the roofing cement results in roofing delays and the cure time for such product results in further delays. Roofing cement is also susceptible to improper application and may not cure well in certain weather conditions.

Some roofers will mount metal flashing underneath the underlayment to avoid the use of roofing cement, however, this technique introduces other problems, including nails being placed through the top side of the underlayment and into flashing components, causing lacerations in the underlayment that can allow water to infiltrate the building envelope. Furthermore, this application method does not prevent moisture backing up behind the drip edge of metal flashings during weather events, such as ice damming.

Still further, the use of metal flashing (e.g. a metal valley pan) in valleys of a roof is commonplace. However, due to expansion and contraction of the flashing can cause oil canning when fasteners are driven through the edge of the metal valley pan, as is typical.

What is needed, therefore, is an apparatus, system, and/or method that allows galvanized nails to be used with aluminum flashing, that removes the need for roofing cement at flashing/underlayment interfaces while maintaining a watertight building envelope, and that reduces or eliminates defects associated with the installation of metal flashing (e.g. oil canning).

SUMMARY OF THE INVENTION

By creating a sandwich-style underlayment that isolates the portion of galvanized fasteners in contact with aluminum flashing from moisture and/or contact, a long-lasting structure can be created, without requiring the use of roofing cement.

Embodiments provide for the elimination of fasteners altogether, preventing fastener-related defects (e.g. oil canning) from occurring.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
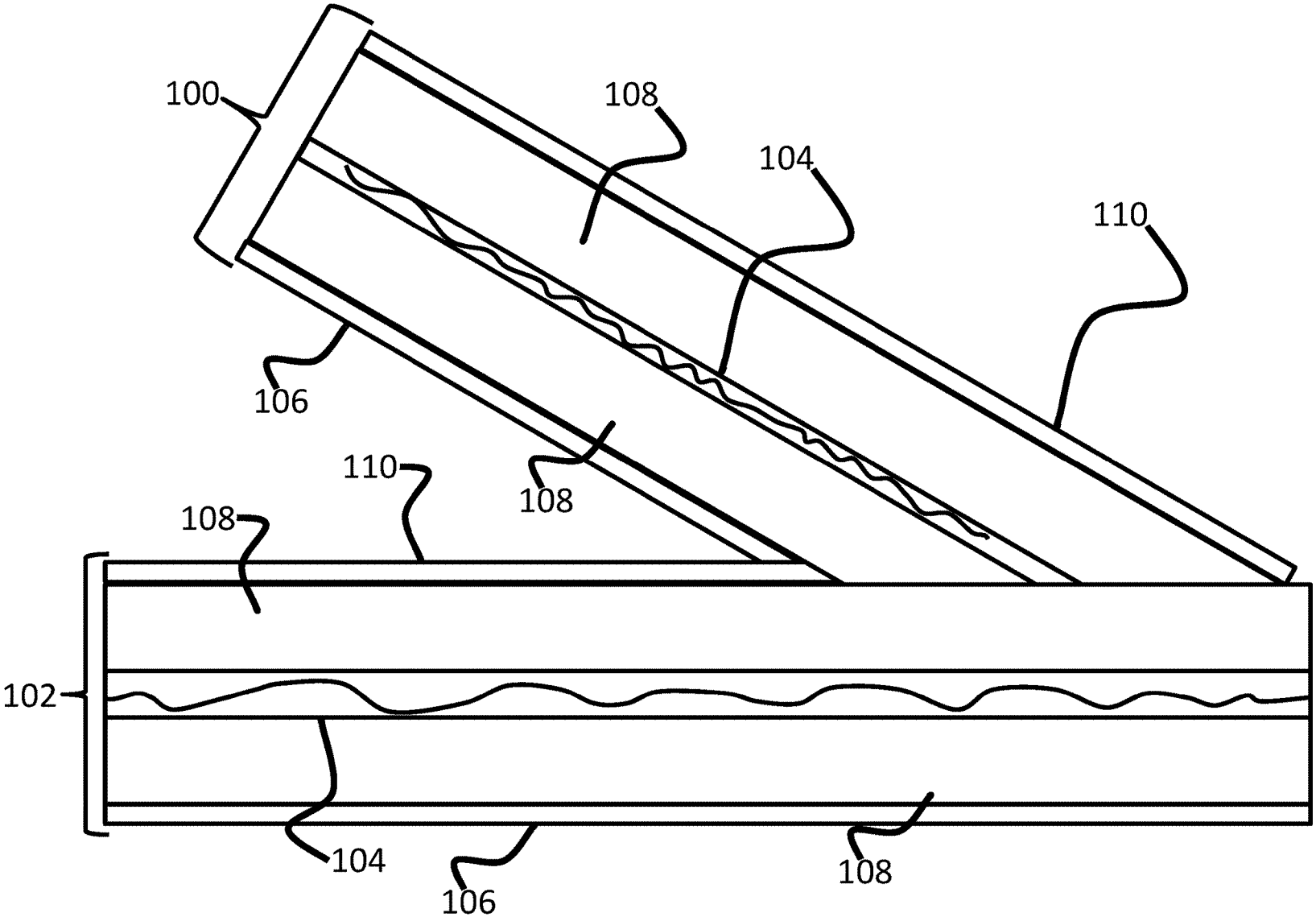
FIG. 1 is a side elevation view of an embodiment of a multi-part underlayment for building envelope details, in accordance with embodiments of the present disclosure.

A roofing product comprising a multi-part underlayment provides significant benefits at least in terms of ease of installation, time of installation, and long term durability. The multi-part underlayment notably forms a pocket that is used to envelope a material, in embodiments metal flashing, both securing it to the roof and protecting it on both top and bottom sides from moisture while providing a smooth transition to a roofing substrate. Embodiments also isolate nails and/or portions thereof that might normally be in contact with the enveloped material when using traditional roofing methods therefrom and prevent the divot formed from driving the nail into the flashing from collecting moisture, reducing the potential for accelerated corrosion (e.g. galvanic corrosion) and helping to ensure the long-term durability of the building envelope and underlying structure.

Combinations of embodiments can be used for other benefits, such as improving walkability, layout potential, or double coverage.

In embodiments, the multi-part underlayment has a relatively small pocket positioned on a leading edge thereof and a much larger, substantially flat underlayment portion configured to extend substantially up a building envelope 600 extending from a trailing edge thereof, permitting for edge metal detail to be inserted into the pocket thereof while the portion that extends substantially up the building envelope 600 protects the structure against ice dams and other sources of moisture intrusion.

In embodiments, the multi-part underlayment disclosed herein is provided in a 36" wide roll.

In other embodiments, the multi-part underlayment is provided in 4" to 18" widths.

In embodiments, a first (lower, roof-contacting) flap 102 is shorter than a second (upper, shingle-contacting) flap 100 of the multi-part underlayment.

In embodiments, the lower, roof-contacting flap 102 extends substantially past a lowest portion of the upper, shingle-contacting flap 100 (the portion thereof positioned on the acute side of the angle formed by the point at which the flaps 100/102 join together) while, in other embodiments, the two are the same length. This allows a lowest section of the lower flap 102 to be folded onto a fascia or rake trim prior to installing a drip edge in the pocket formed by the flaps 100/102. In addition, this design provides clearance for the upper flap 100 from the roof surface, aiding installers in the installation of vertical wall or step flashings.

In embodiments, the lower, roof-contacting flap 102 extends substantially past a topmost portion of the upper, shingle-contacting flap 100 (the portion thereof positioned on the obtuse side of the angle formed by the point at which the flaps 100/102 join together) while, in other embodiments, the two are the same length.

In embodiments, a self-adhesive the upper flap 100 of the pocket is a starter shingle, eliminating the need to apply a separate starter shingle after installation of the multi-part underlayment while enhancing the protection afforded by both components, due to the unitary nature of the structure. In addition, such embodiments also eliminate the requirement to fasten starter shingles to a building envelope 600 using nails while offering superior holding power through the use of adhesives. The elimination of fasteners at critical roof terminations eases installation while eliminating additional fastener holes in the roofing system, further reducing the potential for moisture intrusion.

In yet another embodiment, the upper flap 100 comprises a top surface that is a pressure sensitive material that can be used to adhere traditional starter shingles directly to multi-part underlayment without the use of additional fasteners.

Embodiments may use multiple separate release liners 106, a single release liner 106, or no release liner 106. The release liner 106 of embodiments serves the purpose of preventing the self-adhesive portions of embodiments from adhering together or becoming saturated in particulate until such time as adhesion is desired.

Adhesives used in embodiments comprise butyl rubber-based adhesives, poly-isobutylene based adhesives, and the like and may be pressure sensitive. Alternatively, the adhesive layer can be an adhesive-based rubberized asphalt, thermoplastic elastomers, or tacky resins. SIS (styrene-isoprene-styrene block copolymers), SBS (styrene-butadiene-styrene block copolymers), SEBS (styrene-ethylene-butylene-styrene block copolymers), SBR, natural rubber, silicone rubber, butyl rubber, polyisoprene, polyisobutylene, chloroprene, ethylene-propylene rubber, ethylene alpha olefin, polybutadiene, nitrile rubbers, acrylic rubber, and rubber-modified bitumen pressure sensitive adhesives may also be used. Notably, all of the rubbers listed above, except silicone, may be blended with bitumen to produce a pressure sensitive adhesive. Weatherable, rubbery pressure-sensitive adhesives, such as SEBS, acrylic, silicone, and butyl may be used to provide benefits in terms of durability. Other types of adhesives could also be used without departing from the present invention, as disclosed herein, as would be known to one of ordinary skill in the art.

In embodiments, adhesive 108 is installed only along the lower 1-2" of a nose of flaps 100/102.

In embodiments, a top surface of the upper, shingle-contacting flap 100 comprises one or more polyolefins, polyethylene, polypropylene, a polymer comprising ethylene and propylene, a polymer comprising ethylene and methyl acrylate, a polymer comprising ethylene and ethyl acrylate, a polymer comprising ethylene and butyl acrylate, a polymer comprising ethylene and vinyl acetate, a polymer comprising ethylene and an alpha olefin, or a polymer comprising ethylene and octene. In embodiments, the thickness of the plastic is in the range of 0.5 mils to 10 mils.

In embodiments, the top surface of the upper, shingle-contacting flap 100 comprises a release liner 106 that can be removed to expose an adhesive 108, which may be a pressure-sensitive adhesive 108.

In embodiments, a top surface of the upper, shingle-contacting flap 100 comprises cellulose or similar, non-removable selvage edges 600, made from products such as cellophane, aluminum, copper, and the like.

In embodiments, a top surface of the upper, shingle-contacting flap 100 comprises a granular 500 or sand surface 500.

In embodiments, edges of an upper face of the second (upper, shingle-contacting) further comprise a selvage edge 600.

In embodiments, the multi-part underlayment comprises a scrim 104, providing enhanced stiffness and structural integrity, while in others it does not, allowing for greater flexibility. In embodiments containing a scrim 104, the scrim 104 comprises a random laid fiberglass, a polyolefin film, sun bound polypropylene, woven polypropylene, woven or non-woven fabric, or similar.

In embodiments, no pressure sensitive adhesive is used on one or both of sides of the flap(s) 100/102.

In embodiments, an area where the flaps 100/102 overlapped comprises a nail zone, in which nails are designed to be nailed through, fastening the multi-part underlayment to a building envelope. In such embodiments, the nailing zone may comprise markings showing locations at which nails are intended to be driven.

Furthermore, in embodiments multiple types of pressure-sensitive adhesives are used. For example, a low temperature pressure sensitive adhesive in combination with a high temperature adhesive product is used, with the different types being used on different portions thereof (e.g. a low-temperature adhesive on a lower flap and a high-temperature adhesive on an upper flap, allowing for design flexibility and, potentially, cost savings.

Further embodiments, comprise pressure-sensitive adhesive on at least three surfaces (e.g. a bottom surface of the lower flap 102, a top surface of the lower flap 102, and a bottom surface of the top flap 100), substantially minimizing or completely eliminating the use of fasteners to secure the underlayment to a building envelope.

In embodiments, flashing, such as a drip edge, metal valley pan, or vertical wall flashing with nailing flange, when incorporated into the multi-part underlayment result in the flashing essentially performing as a scrim, providing substantial additional strength to the underlayment, providing the requisite holding power of the detail to the building envelope. Furthermore, the addition of finish materials, such as starter shingles, field shingles, or siding (which are all fastened) adds weight, structural integrity, and holding power to the completed package.

Now referring to FIG. 1, a multi-part underlayment in accordance with embodiments is shown. The top surface of the upper, shingle-contacting flap 100 thereof comprises a non-removable layer 110 that, in embodiments, is made from cellophane, polyethylene, or metal. An underside of the non-removable layer 110 serves as a carrier for a pressure sensitive adhesive 108. An additional carrier is added in the form of a scrim 104, which is encompassed by the pressure sensitive adhesive 108. The bottom of the adhesive mass 108 is covered by a release liner 106 configured for removal prior to installation.

The upper, shingle-contacting flap 100 of FIG. 1 is further fixed to a lower, roof-contacting flap 102 that comprises a central scrim 104 enveloped by an adhesive mass 108, the bottom of which is covered by a release liner 106 configured for removal prior to installation and the top of which comprises a non-removable layer 110 that, in embodiments, is made from cellophane, polyethylene, or metal.

Figure 2:
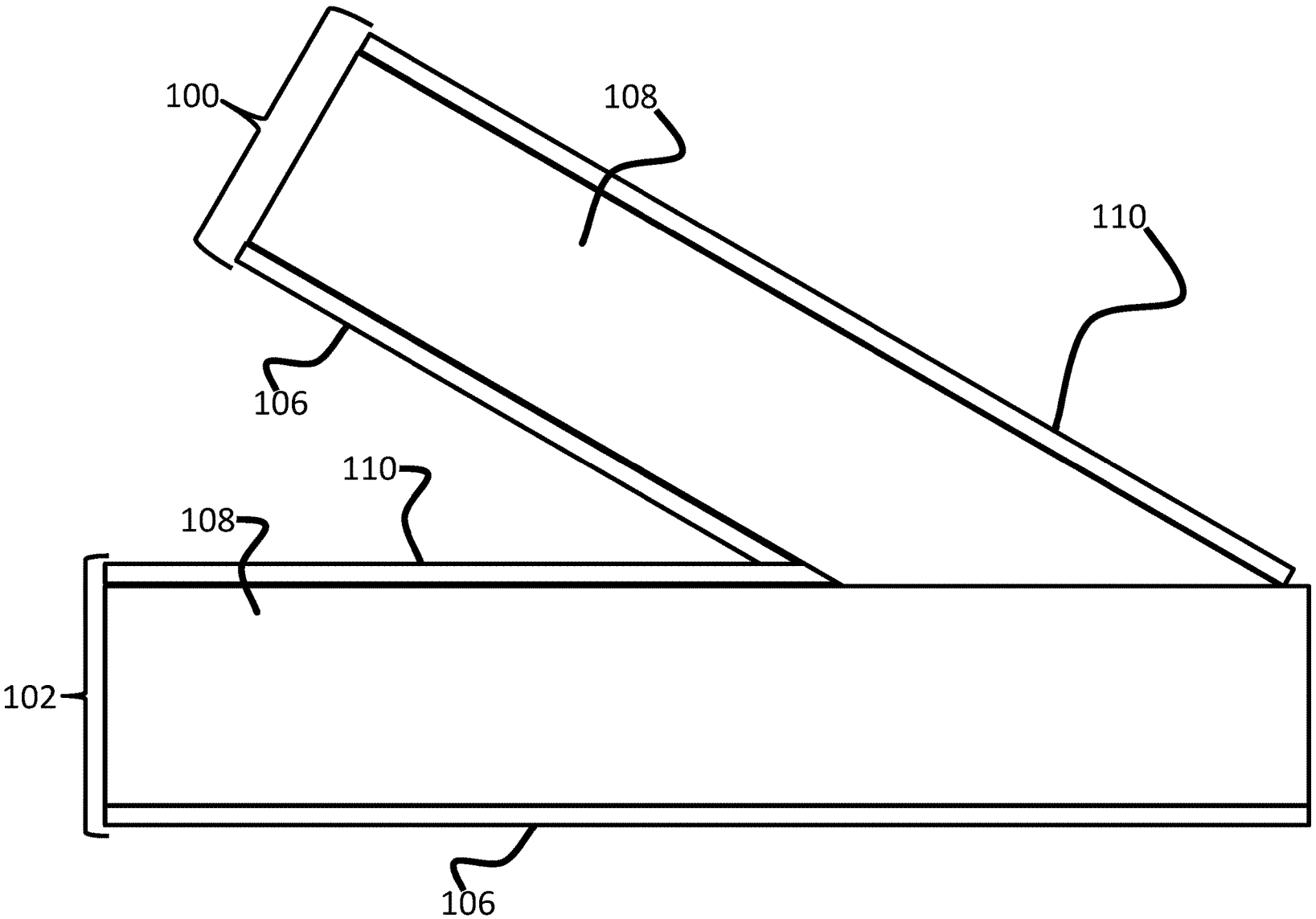
FIG. 2 is a side elevation view of an embodiment of a multi-part underlayment for building envelope details, in accordance with embodiments of the present disclosure.

Now referring to FIG. 2, an alternative embodiment that does not contain a scrim 104 is shown. As such embodiments do not have a scrim, they are reinforced by the top layer 110 or carrier, which, in embodiments, is made of polymer, rubber, metals, or cross-laminated plastic films, such as a high density polyethylene.

In embodiments, each flap 100/102 is approximately 22-30 mils thick, in other embodiments, each flap 100/102 is approximately 40-60 mils thick, while, in still other embodiments, each flap 100/102 is approximately 25-35 mils thick.

Figure 3:
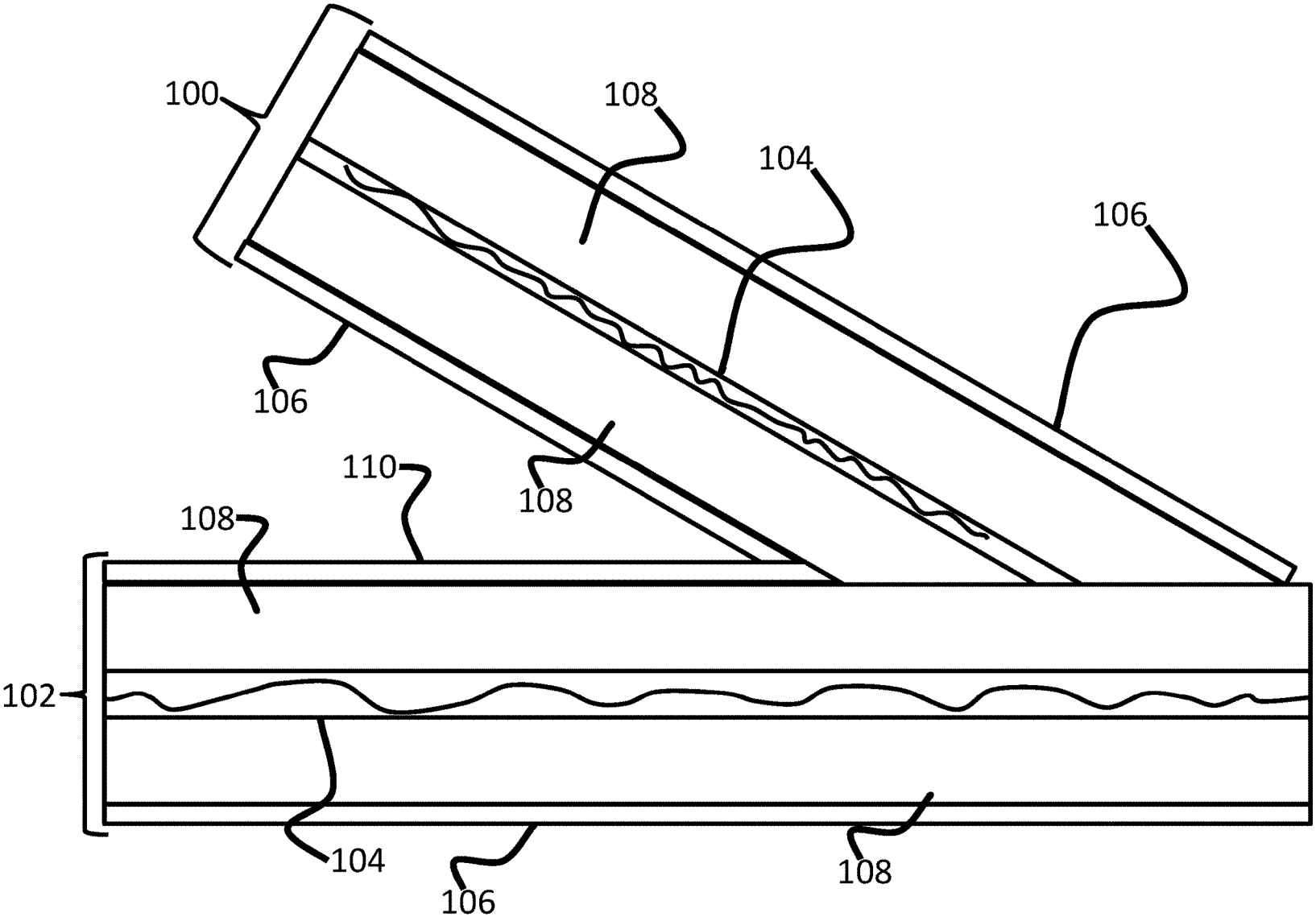
FIG. 3 is a side elevation view of an embodiment of a multi-part underlayment for building envelope details, in accordance with embodiments of the present disclosure.

Now referring to FIG. 3, an alternative embodiment that uses a release liner 106 configured for removal prior to installation on a top surface of the upper flap 100 is shown. By removing release liner 106, the adhesive mass 108 is exposed, allowing for the installation of, for instance, a starter shingle directly onto the upper flap 100 without the use of fasteners.

Figure 4:
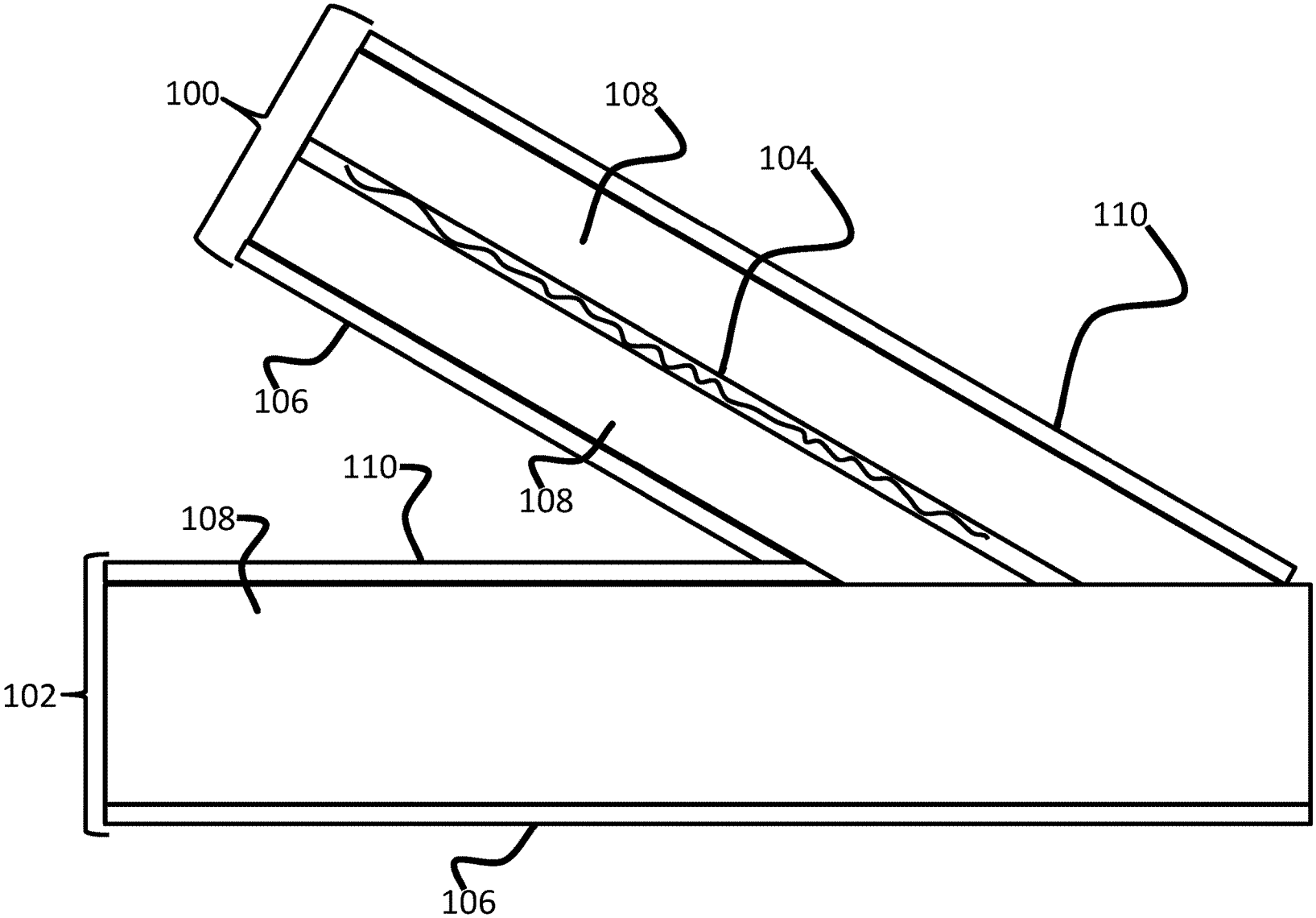
FIG. 4 is a side elevation view of an embodiment of a multi-part underlayment for building envelope details, in accordance with embodiments of the present disclosure.

Now referring to FIG. 4, yet another embodiment of the present disclosure is depicted. This embodiment is similar to that of FIG. 1, but the lower, roof-contacting flap 102 of FIG. 4, unlike FIG. 1, does not comprise a scrim 104, allowing it to be more flexible and to better contour to a building envelope 600. For example, the lack of a scrim in the lower, roof-contacting flap 102 permits this embodiment to fold onto trims, such as fascia, at eave and rake locations.

Figure 5:
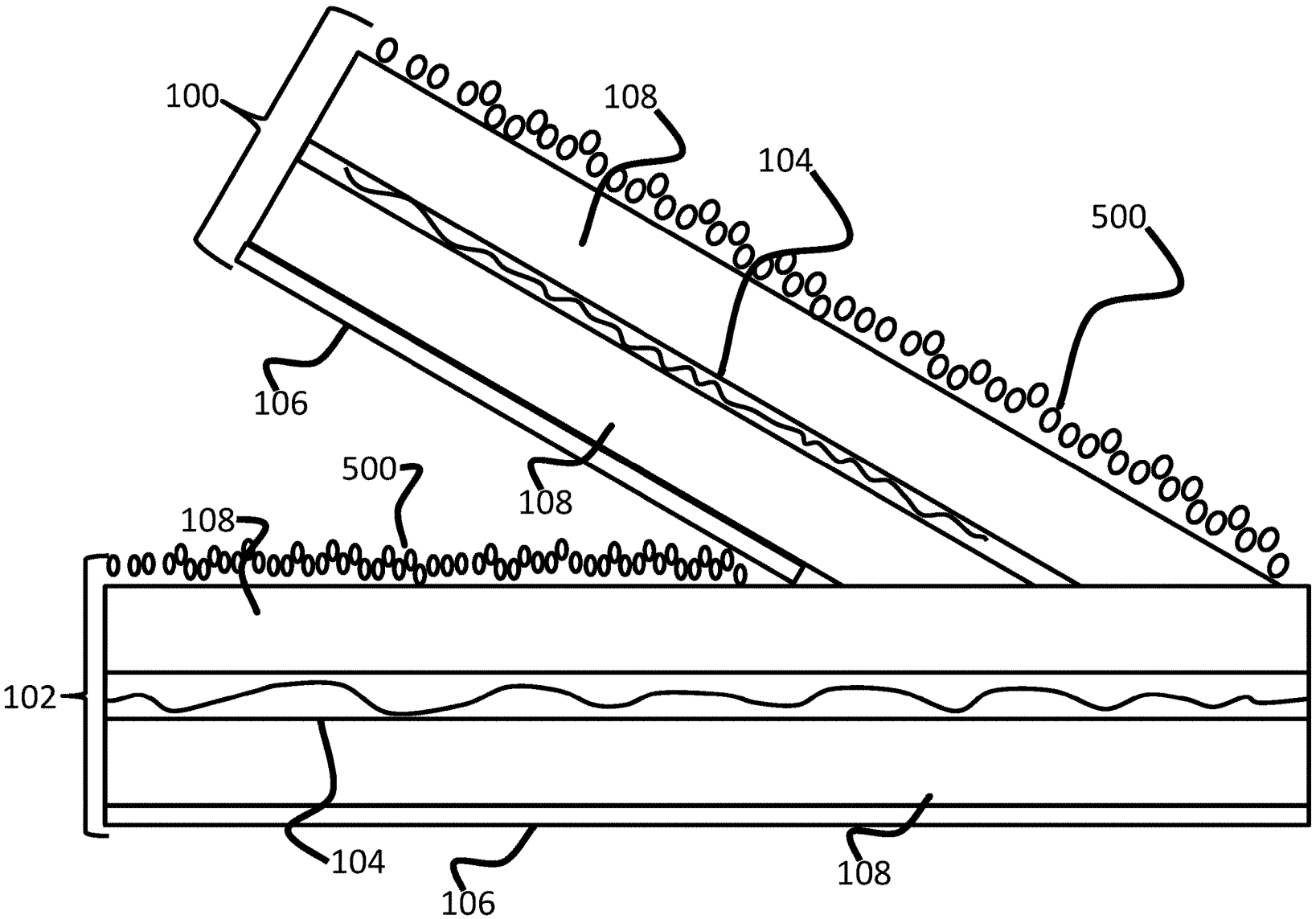
FIG. 5 is a side elevation view of an embodiment of a multi-part underlayment for building envelope details, in accordance with embodiments of the present disclosure.

Now referring to FIG. 5, this embodiment utilizes a granular 500 top surface of each flap 100/102, which may be sand and which may further comprise intermittent selvage edges 600, each oriented parallel to one another with uniform spacing therebetween, such that they may serve as demarcation lines for slitting the product into narrow widths. The selvage edges 600, in embodiments, are installed onto the roof facing a ridge or elevated position, relative to the roof surface.

Figure 6:
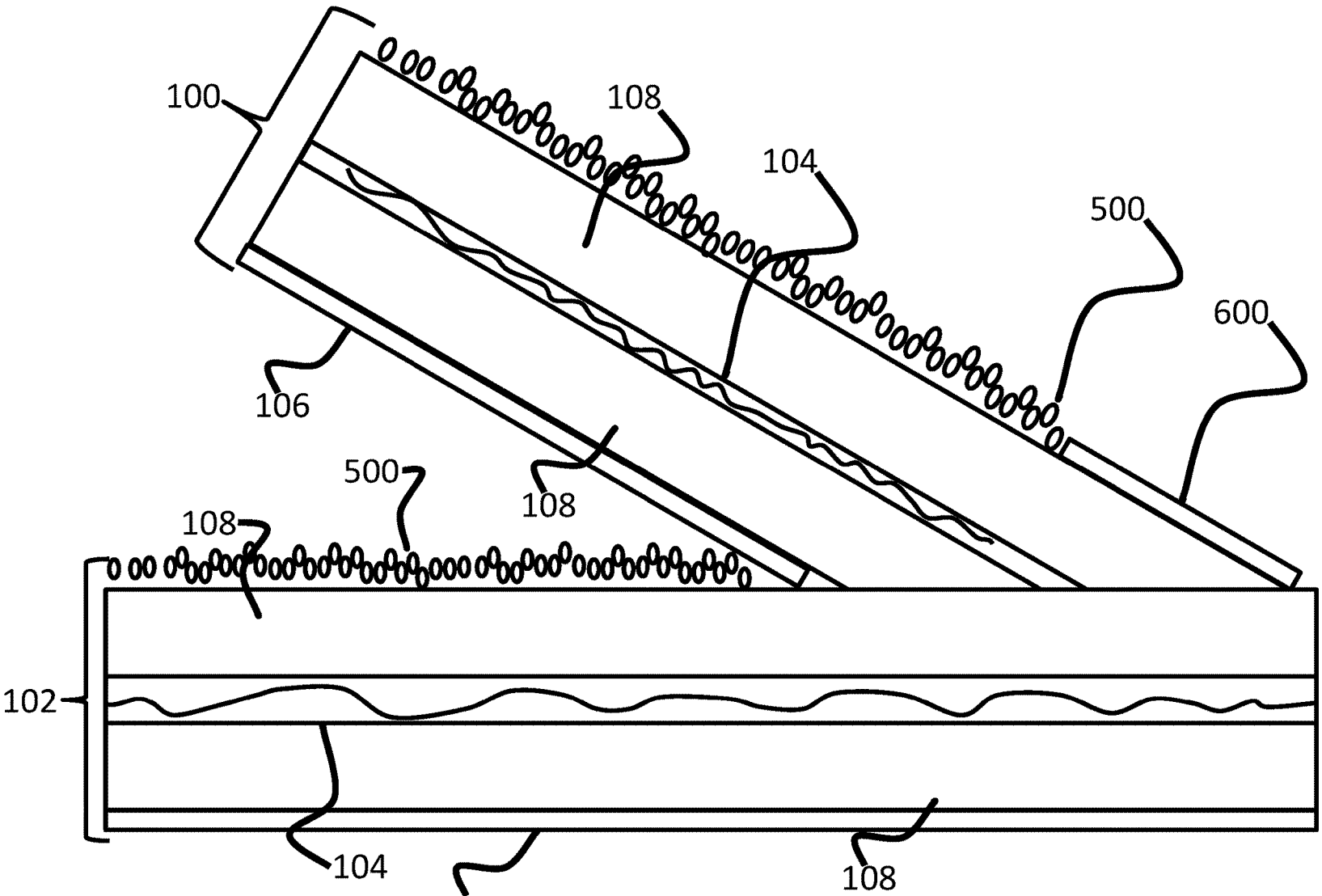
FIG. 6 is a side elevation view of an embodiment of a multi-part underlayment for building envelope details, in accordance with embodiments of the present disclosure.

Now referring to FIG. 6, this embodiment shows the embodiment of FIG. 5 with a selvage edge 600 positioned on the top surface of the upper flap 100, adjacent the point at which the upper and lower flaps 100/102 meet and abutting the granules 500 disposed on the upper flap 100. This configuration allows this portion of the upper flap 100 to receive and retain a roofing component, for instance, a single ply, self-adhesive underlayment.

In embodiments, the selvage edge 600 is made of cellophane, polymers, or the like.

Figure 7:
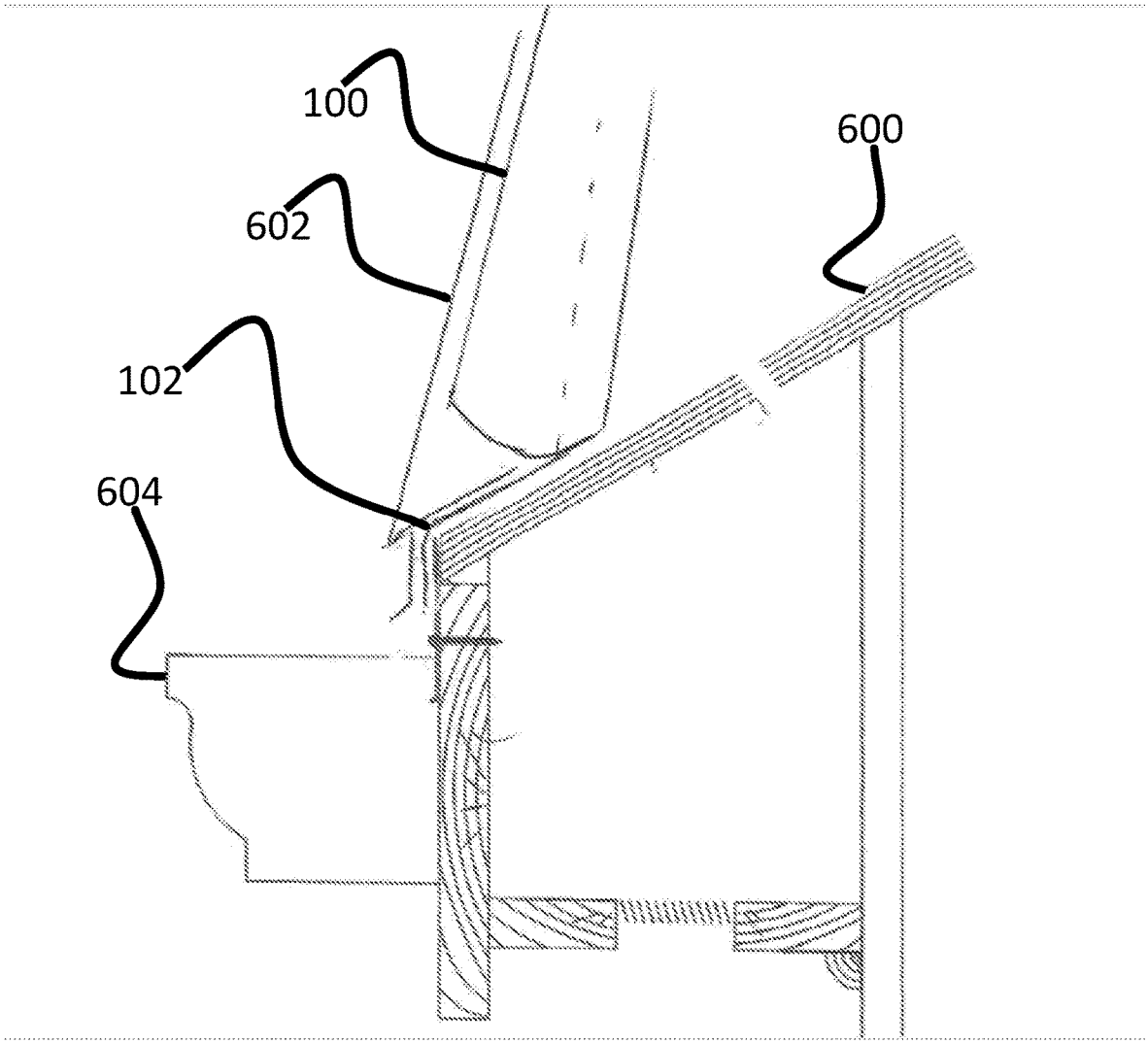
FIG. 7 is a perspective view of an embodiment of a multi-part underlayment for building envelope details partially installed on a building envelope, in accordance with embodiments of the present disclosure.

Now referring to FIG. 7, a multi-part underlayment having an upper flap 100 and lower flap 102, in accordance with embodiments, is depicted partially installed on a building envelope 600, specifically an eave. The lower flap 102 can be seen extending off of the roof and onto a fascia. Furthermore, a drip edge 602 configured to divert moisture away from the building envelope 600 and into a gutter 604 mounted thereon can be seen inserted into the pocket formed by the upper and lower flaps 100/102.

The method of installation of embodiments involves first installing the multi-part underlayment directly to a roof deck by removing a release liner on a bottom section of a first flap and subsequently adhering it to the roof deck by applying downward pressure. A drip edge or similar flashing, depending on the specific area of the structure or roof on which the multi-part underlayment is being installed, is then secured to the multi-part underlayment by elevating the second flap thereof and inserting the flashing/drip edge in the pocket formed by the first and second flaps. In embodiments, a release liner is kept on a bottom section of the second flap and the drip edge is nailed to the roof through the first flap. After the drip edge has been installed, the release liner on a bottom surface of the second flap is removed and the second flap adhered directly to the flashing, fully encapsulating the flashing in the multi-part underlayment while simultaneously covering the exposed nail heads resulting from the flashing installation.

Regarding drip edges, specifically, the drip edge a roofer installs varies by region, availability, preference, code requirements, and the roofing system being installed. The drip edge profile being installed determines the extent to which a given drip edge extends down the fascia or the extent to which the nose of the drip edge protrudes from the fascia itself, or a combination of both. As such, the exact placement of the multi-part underlayment onto the roof varies.

In embodiments, the first flap of the multi-part underlayment is installed such that it covers a top edge of fascia while, in other embodiments, it is installed such that it extends into a gutter.

In embodiments, the multi-part underlayment disclosed herein is installed along an eave and a rake of a roof.

Furthermore, embodiments of the disclosure may be used along cheek walls to protect top-of-wall flashings while providing holding power to house wraps and the like.

In addition, embodiments can be used to lap over the sides of metal valley pans, essentially enveloping the nailing strip on the valley pan for a seamless, watertight installation.

Still further, with roofing being performed almost exclusively outside and not typically water-tight until installation is completed, a partially-finished roof can be very negatively impacted by weather conditions, especially rain and wind.

During certain applications it is advantageous to install the multi-part underlayment onto the drip edge prior to installing the drip edge onto the roof. This can be done in the field or at the point of manufacturing.

It is also advantageous, under certain circumstances, to terminate the multi-part underlayment short of the drip edge terminal point to avoid underlayment visibility at the drip edge overlap. The use of notches or other demarcations, in accordance with embodiments, allow the installer to achieve the proper drip edge overlap and also assist in determining underlayment terminations.

On roof details such as valleys, check walls, and other roof protrusions/terminations, or when found advantageous at eaves and rakes, the multi-part underlayment of embodiments is installed onto both sides of the nail flange only.

Furthermore, the industry standard for self-adhered underlayment's is ASTM D 1970. This is the "Standard Specification for Self-Adhering Polymer Modified Bituminous Sheet Materials Used as Steep Roofing Underlayment for Ice Dam Protection." In many cases when using the underlayment and methods disclosed herein, the metal flashing becomes a type of additional reinforcement to the underlayment. For example, in embodiments, the multi-part underlayment is supplied in a stick form attached to a drip edge. This greatly improves the rated tear resistance, sealability around nails, and elongation at break pursuant to the aforementioned ASTM testing protocols, allowing it to be used at critical roof terminations.

On completed roofing structures, such as where a wall intersects with the roof plain (e.g. a dormer), water is almost always directed back onto the surface of a roof to ensure that it does not flow through the various layers of protection (e.g. shingles that are stepped out, typically using step flashing that directs the water back into the field of the roof), but rather flows over them and off of the structure. Using embodiments of the present disclosure, a roofer can effectively "step out" the underlayment back onto the coursing of new roof shingles, even while under construction, allowing the structure to better handle inclement weather conditions when only partially completed while also allowing roofers to work on the roof when such inclement weather is expected.

On window and door installations, the lower, roof-contacting flap 102 is brought into a rough opening of the window or door opening. The upper flap 100 is then installed over the window or door flange, after the window has been installed, encapsulating the window or door flange.

Embodiments of the present disclosure also allow a roofer to step out the field of the roof. This would be accomplished by using an embodiment having independent release liners on top and bottom surfaces thereof. Using such embodiments, a roofer can periodically incorporate courses of this product into their roofing installation, allowing water to pass over the top portion of shingle and back onto the completed system, while eliminating the possibility of water traveling along the interface of the underside of the shingles and the underlayment or substrate.

Furthermore, while, in this disclosure, we have focused of the utility of embodiments of the present disclosure on a roof, embodiments may also be used to effectively seal doors and windows from moisture intrusion using largely the same methods already discussed, allowing an installer to adhere embodiments of the underlayment disclosed herein directly to sheathing prior to installing a window or door. As such, water would is prevented from travelling under house wraps and bypass tapes that might be applied directly thereto. House wraps may also be adhered directly to a face of the product.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A multi-part underlayment comprising:

an upper flap having a top and bottom surface, upper and lower edges configured to be disposed on a higher and lower portion of a roof, respectively, and a core of flexible, tacky, moisture resistant material; and a lower flap having a top and bottom surface, upper and lower edges configured to be disposed on a higher and lower portion of a roof, respectively, and a core of flexible, tacky, moisture-resistant material, wherein the upper and lower flaps are hingedly fixed to one another along an upper edge of said upper flap, forming a pocket configured to allow the insertion of flashing and the like during installation, the opening of which faces the lower edges of said upper and lower flaps, and wherein said top and bottom surfaces are substantially planar prior to installation.

2. The multi-part underlayment of claim 1 wherein said upper and lower flaps further comprise a scrim disposed substantially centrally within said core of flexible, tacky, moisture resistant material.

3. The multi-part underlayment of claim 1 wherein the top surface of the upper flap and top surface of the lower flap comprise a non-removable layer that serves as a carrier for the flexible, tacky, moisture-resistant material.

4. The multi-part underlayment of claim 3 wherein said non-removable layer is made of a material selected from the group consisting of: cellophane, polyethylene, and metal.

5. The multi-part underlayment of claim 1 wherein said core of flexible, tacky, moisture resistant material is an adhesive.

6. The multi-part underlayment of claim 5 wherein said adhesive is a pressure-sensitive adhesive.

7. The multi-part underlayment of claim 1 further comprising release liners disposed on the bottom surface of said upper flap and on the bottom surface of said lower flap.

8. The multi-part underlayment of claim 1 further comprising:

scrims disposed substantially centrally within said cores of flexible, tacky, moisture resistant material of said upper and lower flaps;

release liners disposed on the bottom surface of said upper flap and on the bottom surface of said lower flap; and non-removable layers that serve as carriers for the flexible, tacky, moisture-resistant material disposed on the top surface of the upper flap and the top surface of the lower flap.

9. The multi-part underlayment of claim 1 further comprising:

release liners disposed on the bottom surface of said upper flap and on the bottom surface of said lower flap; and non-removable layers that serve as carriers for the flexible, tacky, moisture-resistant material disposed on the top surface of the upper flap and the top surface of the lower flap.

10. The multi-part underlayment of claim 1 further comprising:

scrims disposed substantially centrally within said cores of flexible, tacky, moisture resistant material of said upper and lower release liners disposed on the top and bottom surfaces of said upper flap and on the bottom surface of said lower flap; and a non-removable layer that serves as a carrier for the flexible, tacky, moisture-resistant material disposed on the top surface of the lower flap.

11. The multi-part underlayment of claim 1 further comprising:

a scrim disposed substantially centrally within said core of flexible, tacky, moisture resistant material of said upper flap;

release liners disposed on the bottom surface of said upper flap and on the bottom surface of said lower flap; and non-removable layers that serve as carriers for the flexible, tacky, moisture-resistant material disposed on the top surface of the upper flap and the top surface of the lower flap.

12. The multi-part underlayment of claim 1 further comprising:

a scrim disposed substantially centrally within said core of flexible, tacky, moisture resistant material of upper and lower flaps;

release liners disposed on the bottom surface of said upper flap and on the bottom surface of said lower flap; and a granular layer disposed on the top surface of the upper flap.

13. The multi-part underlayment of claim 12 further comprising a granular layer disposed on the top surface of the lower flap.

14. A method of installation of a multi-part underlayment comprising:

providing a multi-part underlayment comprising:

an upper flap having a top and bottom surface, upper and lower edges configured to be disposed on a higher and lower portion of a roof, respectively, and a core of flexible, tacky, moisture resistant material;

a lower flap having a top and bottom surface, upper and lower edges configured to be disposed on a higher and lower portion of a roof, respectively, and a core of flexible, tacky, moisture-resistant material; and release liners disposed on the bottom surface of said upper flap and on the bottom surface of said lower flap, wherein the upper and lower flaps are hingedly fixed to one another along an upper edge of said upper flap, forming a pocket configured to allow the insertion of flashing and the like during installation, the opening of which faces the lower edges of said upper and lower flaps, and wherein said top and bottom surfaces are substantially planar prior to installation, wherein installing the multi-part underlayment further comprises:

removing the release liner from the bottom surface of said lower flap;

adhering the bottom surface of said lower flap to a building envelope;

separating the upper and lower flaps;

inserting flashing between the upper and lower flaps;

removing the release liner from the bottom surface of said upper flap; and adhering the upper flap to the flashing by pressing it against the flashing.

15. The method of installation of a multi-part underlayment of claim 14 further comprising nailing the flashing to the building envelope through the lower flap prior to adhering the upper flap thereto.

16. The method of installation of a multi-part underlayment of claim 14 wherein the flashing is a drip edge.

17. The method of installation of a multi-part underlayment of claim 14 wherein the lower flap of the multi-part underlayment is installed such that it extends onto a fascia.

18. The method of installation of a multi-part underlayment of claim 14 wherein the lower flap of the multi-part underlayment is installed such that it extends into a gutter.

19. The method of installation of a multi-part underlayment of claim 14 wherein the multi-part underlayment is installed along an eave or a rake.

20. The method of installation of a multi-part underlayment of claim 14 wherein the multi-part underlayment further comprises a release liner disposed on the upper surface of said upper flap and wherein the method further comprises removing the release liner disposed on the upper surface of said upper flap and adhering a starter shingle to the upper surface of said upper flap.

* * * * *